US008183449B2

(12) United States Patent
Paulus et al.

(10) Patent No.: US 8,183,449 B2
(45) Date of Patent: May 22, 2012

(54) TUNABLE CLARINET BARREL

(76) Inventors: Henry Paulus, Bornheim-Rösberg (DE); Matthias Schuler, Alfter (DE)

( * ) Notice: Subject to any disclaimer, the term of this patent is extended or adjusted under 35 U.S.C. 154(b) by 15 days.

(21) Appl. No.: 12/990,504

(22) PCT Filed: Apr. 29, 2009

(86) PCT No.: PCT/DE2009/000589

§ 371 (c)(1),
(2), (4) Date: Dec. 19, 2010

(87) PCT Pub. No.: WO2009/135462

PCT Pub. Date: Nov. 12, 2009

(65) Prior Publication Data

US 2011/0146473 A1 Jun. 23, 2011

(30) Foreign Application Priority Data

May 6, 2008 (DE) ..... 20 2008 006 183 U

(51) Int. Cl.
*G10D 9/00* (2006.01)

(52) U.S. Cl. ..... 84/386; 84/382

(58) Field of Classification Search ..... 84/382, 84/386

See application file for complete search history.

(56) References Cited

U.S. PATENT DOCUMENTS

| | | | | | |
|---|---|---|---|---|---|
| 1,163,222 | A | * | 12/1915 | Dennis | 84/386 |
| 1,171,647 | A | | 2/1916 | Reynolds | |
| 1,308,903 | A | * | 7/1919 | Gulick | 84/386 |
| 1,361,629 | A | * | 12/1920 | Sinclair | 84/386 |
| 1,365,860 | A | * | 1/1921 | Sinclair | 84/386 |
| 1,374,758 | A | * | 4/1921 | Nenneker | 84/386 |
| 1,416,898 | A | * | 5/1922 | Sinclair | 84/386 |
| 1,736,880 | A | * | 11/1929 | Gulick | 84/386 |
| 1,867,481 | A | * | 7/1932 | Todt | 84/386 |
| 2,036,356 | A | * | 4/1936 | Pedler | 84/382 |
| 2,098,457 | A | * | 11/1937 | Loomis | 84/386 |
| 2,485,021 | A | * | 10/1949 | Strupe | 84/386 |
| 5,249,499 | A | * | 10/1993 | Goldstein et al. | 84/386 |
| 5,291,817 | A | * | 3/1994 | Smith | 84/386 |
| 5,864,076 | A | * | 1/1999 | Eder | 84/382 |
| 7,148,411 | B2 | * | 12/2006 | Hsieh | 84/386 |
| 2011/0146473 | A1 | * | 6/2011 | Paulus et al. | 84/382 |

FOREIGN PATENT DOCUMENTS

| | | |
|---|---|---|
| FR | 649265 | 12/1928 |
| FR | 2104377 | 4/1972 |

* cited by examiner

*Primary Examiner* — Elvin G Enad
*Assistant Examiner* — Robert W Horn
(74) *Attorney, Agent, or Firm* — Smartpat PLC; Axel Nix

(57) ABSTRACT

The present invention relates to a tuneable clarinet barrel joint (1) for arrangement between the mouthpiece and the upper joint of a ($E^b$, D, C, A or $B^b$) clarinet, with a longitudinal axis (L) and a bore (100) which runs in the longitudinal axis (L), whereby the clarinet barrel joint (1) is comprised of an upper part (2) and a lower part (3), which are arranged for connection in the longitudinal axis (L), and provided with a set collar (4) for the connection of the upper part (2) and the lower part (3), by means of which the distance between the upper part (2) and the lower part (3) is adjustable, characterized in that the set collar (4) is connected to both the upper part (2) and the lower part (3) by means of screw threads (6, 7), whereby the said screw threads (6, 7) are pitched with opposing directions of rotation.

7 Claims, 4 Drawing Sheets

TUNABLE CLARINET BARREL

TECHNICAL FIELD

The invention relates to a tuneable clarinet barrel joint, for arrangement between the mouthpiece and the upper joint, whereby the barrel joint is divided into an upper part and a lower part and a set collar is provided for the connection of these two parts, by means of which the axial distance between the upper part and the lower part can be adjusted.

BACKGROUND OF THE INVENTION

The clarinet forms part of the woodwind family of instruments. It generally consists of five joinable parts: the mouthpiece, the barrel joint, the upper joint, the lower joint and the bell. These parts are generally connected by means of cork-wrapped tenons and corresponding seatings for these tenons, which are provided on each individual part at the relevant points of connection. If all five parts of the clarinet are fitted together, such that there are no gaps between the individual parts, a continuous bore of essentially uniform internal diameter will be formed in the interior of the clarinet, extending from the mouthpiece, through the barrel joint, the upper joint and the lower joint down to the bell.

As the musical repertoire of the clarinet includes pieces for soloists, as well as pieces for chamber groups and orchestras of various compositions, it is necessary for instruments to be tuned to each other, particularly where a number of musicians are playing in consort. In this regard, the pitch of a given note will depend upon instrument-specific factors and upon variable environmental influences, specifically the ambient temperature, which will have a direct impact upon the temperature of the instrument. In all woodwind instruments, the pitch of a given note will rise as the temperature of the instrument increases.

Where a number of musicians are to play in consort, instruments will generally be tuned to each other before the start of playing. As wind instruments are warmed by the stream of warm air from the player's lungs, it will generally be necessary to retune instruments in the course of concert playing. Many works or pieces of music also require a change of instrument, e.g. from an A clarinet to a $B^b$ clarinet, in the course of piece, such that the clarinet not in use will cool down again, and will require retuning as a result.

In all wind instruments, the longer the vibrating column of air in the instrument, the lower the resulting note will be. The lengthening of the vibrating column of air is generally achieved by slightly pulling out one or more parts of the instrument. In the case of the clarinet, a deeper pitch is generally achieved by drawing the barrel joint a little further out of the upper joint or out of the mouthpiece.

By this action of withdrawal, the above-mentioned continuous bore at the point of connection, e.g. between the barrel joint and the upper joint, will be extended by a length which corresponds to the withdrawal concerned. The resulting internal hollow space and external gap will adversely affect the tonal qualities and intonation of the instrument, and will also form a site for the accumulation of unwanted condensation, which will impair the playing qualities of the instrument. Immediately the barrel joint is pulled out of e.g. the upper joint, the only remaining connection between these parts of the clarinet will be formed by the sound-damping cork, with a resulting impairment to the tone of the instrument.

The provision of a metal sleeve for the bridging of the hollow space is known e.g. from U.S. Pat. No. 1,416,898, whereby the said sleeve is inserted telescopically into the clarinet bore and can be removed from the latter. However, on the grounds of the complexity of mounting a sleeve of this type, together with the influence of the insertion of a metal component upon the tone of the instrument, a mechanism of this type has not been introduced into clarinet construction to date.

The formation of the barrel joint as a two-part wooden component, comprising an upper part and a lower part, in which the above-mentioned sleeve is incorporated integrally to one part of the barrel joint, is also known. A sleeve of this type, configured integrally to part of the barrel joint, is disclosed e.g. in U.S. Pat. No. 5,249,499. The clarinet barrel joint described herein comprises an upper part and a lower part, whereby a set collar is provided between the upper part and the lower part for the connection thereof. The upper part is screwed into the set collar, and the lower part is arranged to rotate on the set collar. By the rotation of the set collar, the axial distance between the upper part and the lower part can be adjusted.

A drawback of this arrangement is the fact that, upon the rotation of the set collar, the upper and lower parts of the barrel joint can essentially rotate in opposite directions. The rotation of the lower part of the barrel joint simultaneously to the movement of the set collar is prevented by the rotatable mounting of the lower part on the set collar. If this is to be achieved, the lower part must show the least possible resistance to the rotational movement of the set collar. However, this means that, even under normal playing conditions, the lower part of the barrel joint will be very easily rotatable in relation to the set collar and the upper part of the barrel joint, which is a substantially undesirable characteristic.

SUMMARY OF THE IVNENTION

Accordingly, the object of the present invention is the proposal of a tuneable clarinet barrel joint, which will allow straightforward tuning without the mutual rotation of the upper and lower parts of the barrel joint.

This object is fulfilled by a tuneable clarinet barrel joint with the characteristics described in the independent claim. Advantageous further developments are described in the dependent claims.

The tuneable clarinet barrel joint according to the invention comprises a bore which is arranged in the longitudinal axis thereof and is divided into an upper part and a lower part, which are arranged for connection in the longitudinal axis, and a set collar which is arranged between the upper part and the lower part, by means of which the axial distance between the upper part and the lower part may be adjusted. The invention provides for the connection of the set collar to the upper part and the lower part by means of a screw thread in each case, whereby these screw threads are arranged for opposite directions of rotation.

By the use of a screw thread for the connection of the set collar to the upper part and the lower part, whereby one screw connection is provided with a left-hand thread and the other with a right-hand thread, the axial distance between the upper part and the lower part can be adjusted by the rotation of the set collar, without altering the original orientation of the upper part and the lower part in relation to each other. Specifically, this will allow the player to tune their instrument during playing, i.e. without putting the instrument down, as the set collar can be comfortably operated by hand, and the readjustment of the orientation of the upper part to the lower part will not be required, as these will not rotate in relation to each other. The upper part and the lower part move together and apart in a linear direction, on a longitudinal axis.

In addition to the rotation-free outward and inward movement of the upper part and the lower part, the set collar also provides a distinctly superior quality of tone and pitch, in comparison with a one-piece clarinet barrel joint in accordance with the prior art. As the use of a barrel joint in accordance with the invention will obviate the formation of gaps, both longitudinally in the internal bore and in the outer part of the clarinet, the undamped transmission of vibrations will be possible, both in the interior of the instrument and in the outer skin of the barrel joint.

In one form of execution of the invention, a locking device is provided, such that the orientation of the upper part to the lower part will be securely maintained. For example, the locking device may be configured as a minimum of one guide pin which extends from the upper part to the lower part, such that the mutual orientation of the upper part and the lower part will be securely maintained.

In order to eliminate the above-mentioned problem of the formation of gaps associated with the outward movement of the upper part and the lower part, one of these parts, preferably the upper part in one form of execution of the invention, will be provided with a projecting, thin-walled connecting sleeve for insertion into the lower part. The internal diameter of this connecting sleeve will be essentially equal to the internal diameter of the barrel joint bore such that, even in case of the outward movement of the barrel joint, a bore of essentially constant internal diameter will be maintained. The connecting sleeve may be configured separately, or may be integral to the component concerned.

The lower part will preferably be formed of wood. In one form of execution of the invention, the wooden lower part of the barrel joint according to the invention and the upper joint of the clarinet may be configured integrally. This will eliminate a tenon and socket joint between the lower part of the barrel joint and the upper joint of the clarinet.

In a further form of execution of the invention, the upper part and/or the lower part, including the connecting sleeve where applicable, may be formed of rubber or plastic. The plastic in question may be e.g. polyoxymethylene (POM), although the use of other plastics will be possible.

The upper part and/or the lower part may be advantageously provided with a ring nut which forms part of the screw thread. This may be configured e.g. as a metal or plastic ring, thereby simplifying construction. This ring nut may be secured to the upper part and the lower part e.g. by screwing and/or by adhesive.

The screw thread on the upper part and the lower part will preferably be configured with a pitch ranging from 0.8 mm to 1.2 mm, whereby a pitch of 1 mm will be specifically preferred. This will ensure that the instrument can be adjusted with a high degree of precision.

A scale of markings will preferably be applied to the set collar, in order to ensure that adjustments can be accurately reproduced. This is of specific benefit where it is already known that, in consort with other instruments, the player's own instrument sounds one or more cycles (hertz) too high or too low.

In one form of execution of the invention, the transition from one marked gradation on the set collar to the next marked gradation will correspond to an adjustment in the axial spacing between the upper part and the lower part of 0.2 mm to 0.8 mm, and preferably of 0.5 mm.

In another form of execution of the invention, the transition from one marked gradation to the next marked gradation will correspond to a pitch adjustment of 0.5 Hz to 1.5 Hz, whereby 1 Hz will be specifically preferred.

It is understood that the invention is applicable to all members of the clarinet family, i.e. $E^b$, D, C, A and $B^b$ clarinets, and basset clarinets. In the case of basset horns and bass clarinets, the invention may be incorporated by the corresponding dimensional adjustments to the swan neck. The swan neck may be of wooden construction and/or of partial or total plastic construction (e.g. POM). The design, execution and materials of the invention, specifically the threaded element and the use of plastics (specifically POM) will also be applicable to other woodwind instruments. This will apply to all flutes, including piccolos; all oboes, including the cor anglais and heckelphone; and to bassoons, including the contrabassoon.

The minimum length of the barrel joint according to the invention for use in A or $B^b$ clarinets, i.e. the length associated with the closest spacing between the upper part and the lower part, together with the dimensions of the bore, can be considered in the manufacturing process, in accordance with the wishes and requirements of the individual clarinetist concerned. The clarinet barrel joint according to the invention will preferably be of minimum length ranging from 53 mm to 65 mm, whereby a length from 54 mm to 58 mm will be specifically preferred. The internal diameter of the bore of the tuneable clarinet barrel joint according to the invention will preferably range from 14.5 mm to 15.5 mm, whereby a dimensional range of 14.9 mm to 15.1 mm will be specifically preferred, in each case for an $A/B^b$ clarinet.

BRIEF DESCRIPTION OF DRAWINGS

Further purposes, characteristics, advantages and potential applications for the tuneable clarinet barrel joint may be derived from the following description of one form of execution, with reference to the drawings. To this end, all specified and/or diagrammatically represented characteristics shall be an object of the invention, whether individually or in any combination desired, regardless of the association thereof in individual claims or any back reference thereto.

The drawings show the following.

DETAILED DESCRIPTION

Figure 1:
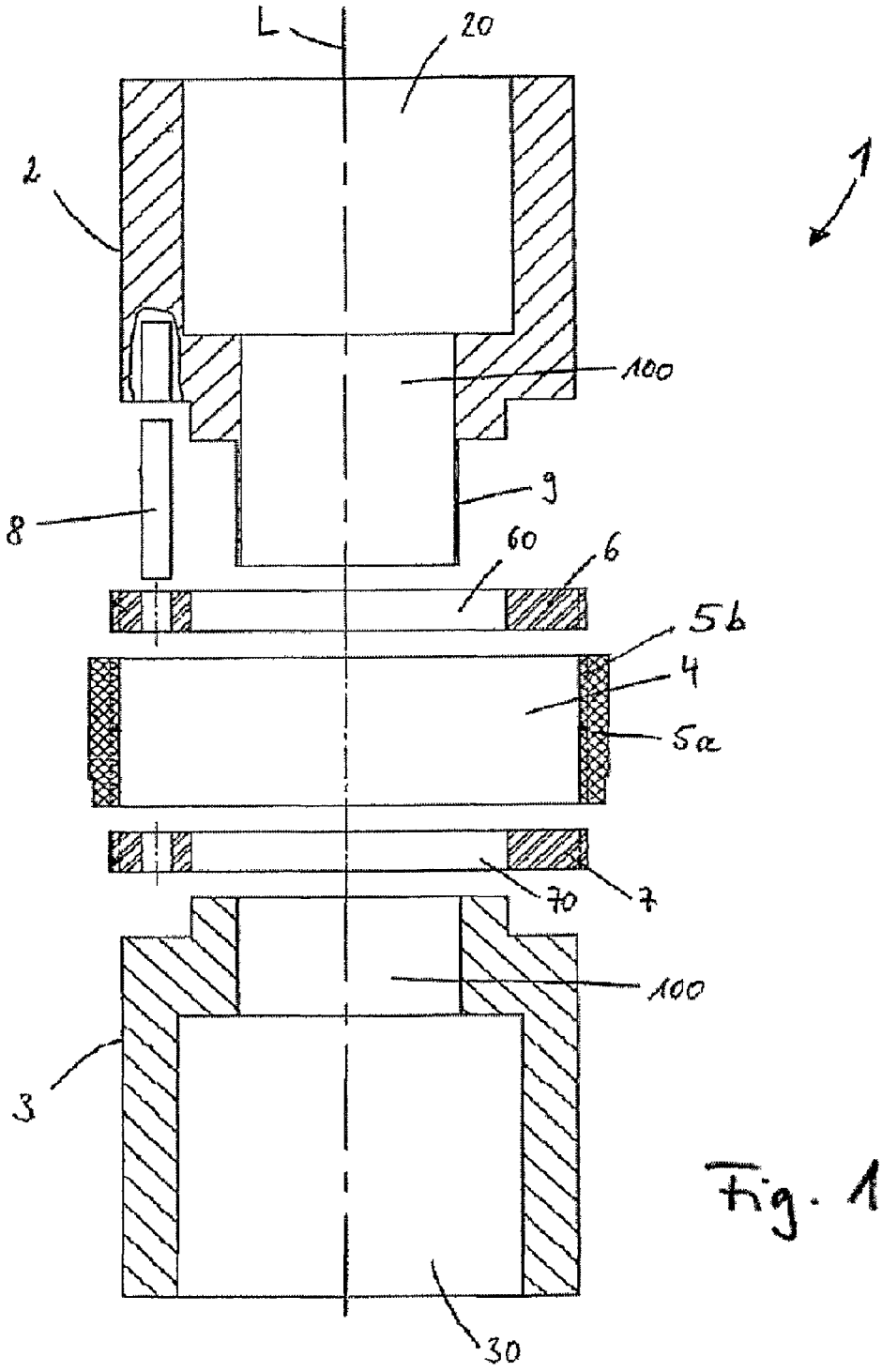
FIG. 1 is an exploded sectional view of a clarinet barrel joint according to the invention.
Figure 2:
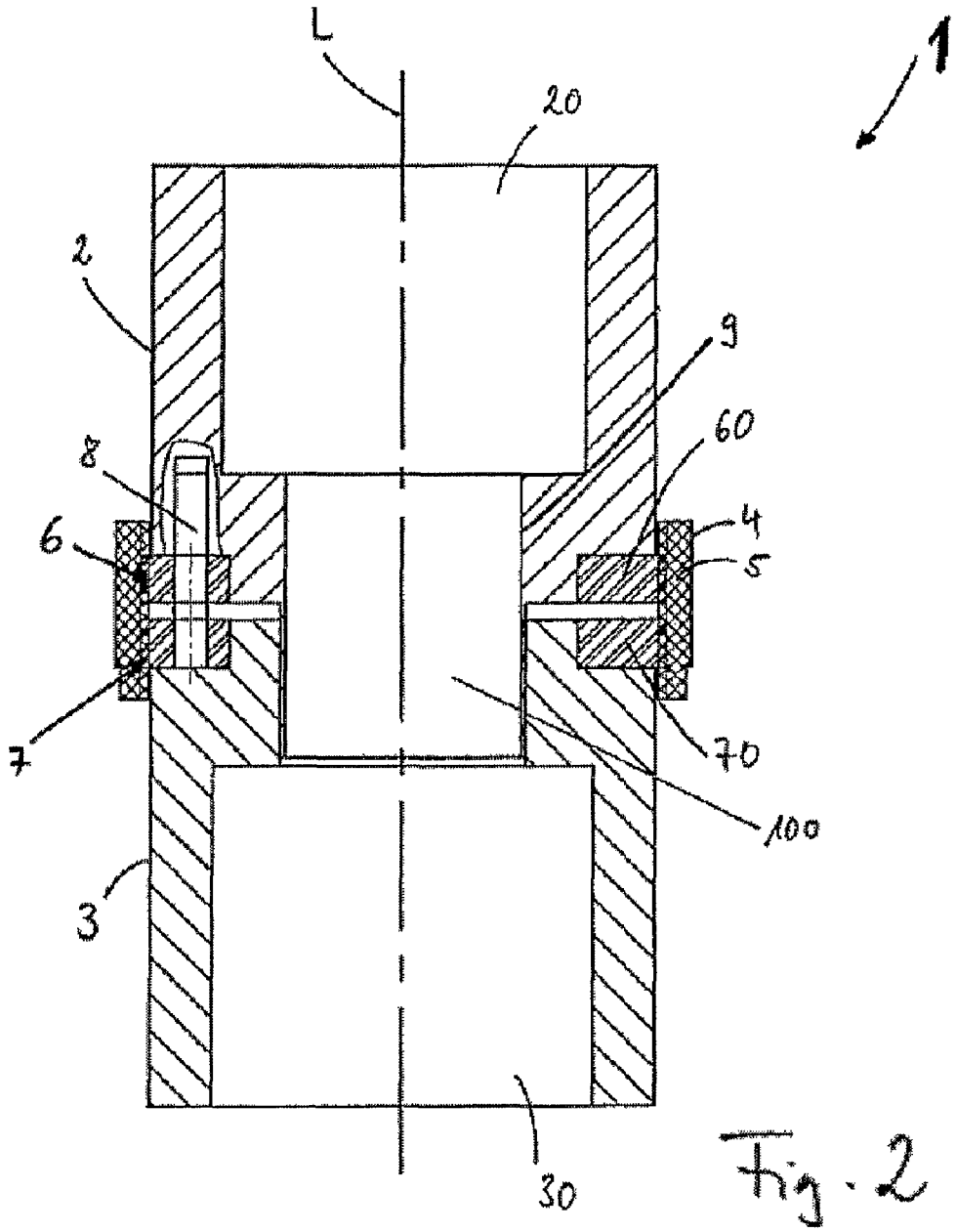
FIG. 2 is a sectional view of a fully-closed clarinet barrel joint according to the invention.

FIGS. 1 and 2 represent a tuneable clarinet barrel joint according to the invention, which is designated overall as 1. It comprises an upper part 2 with a receiving opening 20 for a clarinet mouthpiece, not represented here, and a lower part 3 with a receiving opening 30 for the upper joint of a clarinet, also not represented here. The receiving openings (20, 30) are connected by a bore (100), and the upper part 2 and the lower part 3 are arranged for connection in the longitudinal axis L of the clarinet barrel joint 1. For the secure connection of the upper part 2 to the lower part 3, a set collar 4 with two internal threads 5*a* and 5*b* is provided, by means of which the axial distance between the upper part 2 and the lower part 3 is adjustable. In each case, the internal threads 5*a*, 5*b* extend to the end of the set collar in the longitudinal axis L.

At the end facing their respective receiving opening 20, 30, both the upper part 2 and the lower part 3 are provided with a metal ring nut 60, 70, both of which carry an external thread 6, 7. The ring nut 60, 70 may be secured to a stepped seating on the upper part and lower part 2, 3 by means of adhesive or screwing. The external thread 6 applied to the upper part 2 is a right-hand thread, whereas the external thread 7 applied to the lower part 3 is a left-hand thread. The set collar 4 is provided with corresponding internal threads 5*a*, 5*b* such that, in the upper part, a mating thread 5*b* to the external thread 6 and, in the lower part, a mating thread 5*a* to the external thread 7 are provided. By this arrangement, the upper part 2 can be screwed into the set collar 4 from above by means of the right-hand external thread 6, and the lower part 3 can be screwed into the set collar 4 from below by means of the left-hand external thread 7. It is understood that the arrangement of these external threads, i.e. their direction of rotation, can also be reversed. Accordingly, it can be established beforehand whether the extension of the clarinet barrel joint is to be achieved by the rotation of the set collar 4 to the left or to the right.

With the set collar in the position represented in FIG. 2, in which both the upper part 2 and the lower part 3 are screwed into the set collar 4 to the maximum extent, the longitudinal and axial outward movement of the upper part 2 and the lower part 3 from this position is achieved by the rotation of the set collar 4 in a clockwise direction, thereby allowing the instrument to be tuned to a lower pitch. Correspondingly, the counter-clockwise rotation of the set collar 4 thereafter will reduce the linear spacing between the upper part and lower part 2, 3, thereby raising the pitch of the instrument accordingly.

A major advantage of this mechanism is the fact that the set collar 4 can be comfortably operated by hand, without putting down the instrument. Accordingly, the intonation of the instrument can be adjusted at any time, without the necessity of putting down the instrument. The ease of use of this mechanism makes it particularly suitable for use by amateurs.

As shown in FIG. 2, the screw thread and set collar assembly, comprising the set collar 4 and the ring nuts 60 and 70, will preferably be configured and fitted to the clarinet barrel joint 1 such that it encompasses only the bores 100 of the upper part 2 and the lower part 3. Accordingly, in this form of execution, the receiving openings 20, 30 are not encompassed by the screw thread and set collar assembly 4, 60, 70. In a particularly advantageous form of execution, the screw thread and set collar assembly 4, 60, 70 is essentially arranged midway (albeit not precisely) between the receiving openings 20, 30.

Figure 4:
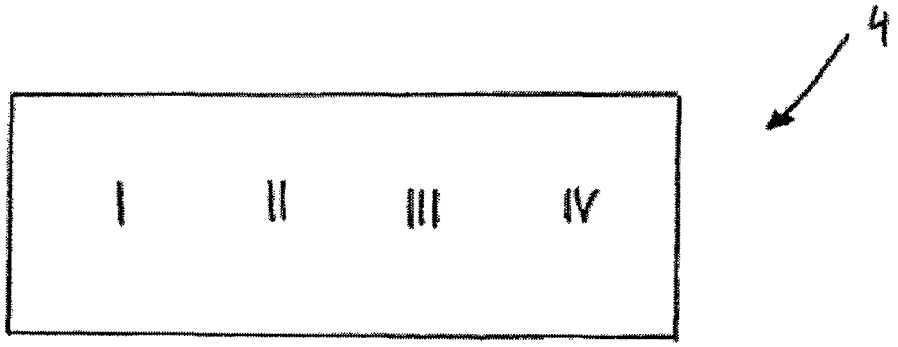
FIG. 4 is a frontal view of the set collar of a clarinet barrel joint according to the invention.

FIG. 4 shows a frontal view of the set collar 4. The circumference of the set collar 4 is provided with markings, preferably in Roman numerals, such that the transition from one marked gradation to the next marked gradation will effect a predetermined adjustment to the pitch of the instrument, e.g. by 1 Hz. By means of these markings, reproducible adjustments between the upper part and the lower part of the clarinet barrel joint will be possible. Markings may also be provided e.g. as a scale of millimeters or a scale of frequencies, in hertz.

The combination of a right-hand external thread 6 and a left-hand external thread 7 obviates any rotation of the upper part 2 in relation to the lower part 3 when the set collar 4 is rotated. In practice, the upper part and the lower part 2, 3 will remain in a fixed orientation to each other, and only the axial movement thereof, whether together or apart, will effected by the rotation of the set collar 4. A guide pin 8, which is accommodated by a recess in the upper part 2, and which extends through both of the ring nuts 60, 70, provides further security against rotation.

In order to prevent the formation of a gap upon the outward movement of the upper part 2 and the lower part 3, the upper part 2, in the vicinity of the bore 100, is provided with a thin-walled connecting sleeve 9, which is configured integrally to the upper part 2, the external diameter of which will only be smaller than the internal diameter of the bore 100 to the extent that the connecting sleeve 9 will fit exactly into the bore 100 of the lower part 3. Naturally, a form of execution will also be conceivable in which the connecting sleeve 9 is provided in the lower part 3, which then engages with the bore 100 in the upper part 2.

In the position shown in FIG. 2, in which the upper part 2 and the lower part 3 are set as close together as possible, the maximum overlap between the connecting sleeve 9 and the bore 100 of the lower part 3 will result. From this position, the clockwise rotation of the set collar 4 will effect the outward axial movement of the upper part 2 and the lower part 3, with the resulting telescopic movement of the connecting sleeve 9 out of the bore 100 of the lower part 3. The continuing presence of an, albeit reduced, overlap between the connecting sleeve 9 and the bore of the lower part 3 will prevent the formation of a gap upon the outward movement of the upper part 2 and the lower part 3.

In the form of execution of the tuneable clarinet barrel joint 1 represented in FIGS. 1 and 2, the lower part 3 is formed of granadilla wood, to match the clarinet itself, whereas the upper part 2, including the connecting sleeve 9, is formed of an appropriate plastic, such as e.g. POM. Delrin, produced by DuPont, is an example of an appropriate polyoxymethylene for this purpose.

The internal thread 5 of the set collar 4 and the external threads 6, 7 of the upper part 2 and the lower part respectively will be configured with a pitch of e.g. 1 mm. Accordingly, one complete rotation of the set collar 4 will effect a longitudinal adjustment to the clarinet barrel joint 1 of e.g. 0.5 mm, or a pitch adjustment of 1 Hz.

Figure 3:
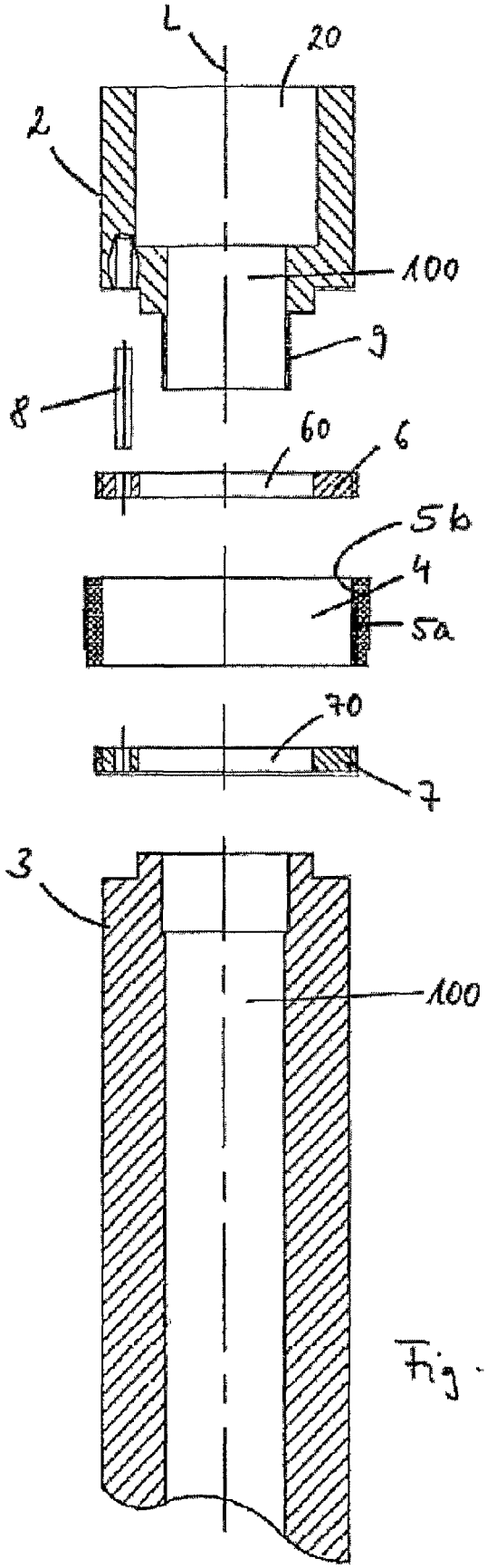
FIG. 3 is an exploded sectional view of a further example of execution of a clarinet barrel joint according to the invention, in which the lower part and the upper joint of the clarinet are configured as a single component.

FIG. 3 represents a form of execution of the clarinet barrel joint according to the invention, in which the lower part 3 is configured integrally to the upper joint of the clarinet. In this case, the tenon and socket joint between the lower part 3 and the upper joint in the clarinet, which is not represented in FIGS. 1 and 2 but which will nevertheless be required, may be omitted. In other respects, the design of the clarinet barrel joint will be identical to the design described in reference to FIGS. 1 and 2.

The execution of the clarinet barrel joint according to the invention is not restricted to the preferred forms of execution described above. In practice, a multitude of variations in design will be feasible, which might use essentially different forms of execution to the solution presented.

LIST OF REFERENCE NUMBERS

1 Tuneable clarinet barrel joint
2 Upper part
3 Lower part
4 Set collar
5*a*, 5*b* Internal thread on 4
6 Right-hand external thread on 2
7 Left-hand external thread on 3
8 Guide pin
9 Connecting sleeve
20 Receiving opening on 2
30 Receiving opening on 3

60 Ring nut on 2
70 Ring nut on 3
100 Bore
L Longitudinal axis

The invention claimed is:

1. A tuneable clarinet barrel joint for arrangement between a mouthpiece and an upper joint of a clarinet, the tunable clarinet barrel joint having a longitudinal axis and a bore which runs in the longitudinal axis, comprising:

an upper part and a lower part, the upper part and the lower part being arranged for connection in the longitudinal axis;

a set collar connecting the upper part and the lower part such that the distance between the upper part and the lower part is adjustable;

screw threads connecting the set collar to both the upper part and the lower part, the screw threads being pitched with opposing directions of rotation;

a projecting connecting sleeve of the upper part for insertion into the lower part; and ring nuts at both the upper and the lower part which form part of the screw threads and which form the opposite ends of a hollow space between the upper part and the lower part below the set collar, wherein the ring nuts are exactly fitted into recesses of each the upper part and lower part such that formation of a gap on the inside along the bore as well as on the outside of the clarinet is prevented.

2. A tuneable clarinet barrel joint as in claim 1, wherein the ring nuts or the screw threads are extending beyond the upper part and the lower part, such that the set collar is touching only the screw threads and not the body of upper part and lower part.

3. A tuneable clarinet barrel joint as in claim 1, wherein the ring nuts and the set collar form an assembly, and wherein the ring nut and set collar assembly is configured and fitted to the clarinet barrel joint such that the assembly encompasses only the bores of the upper part and the lower part.

4. A tuneable clarinet barrel joint as in claim 3, wherein the ring nut and set collar assembly is essentially arranged midway between receiving openings of the mouthpiece and the upper joint.

5. A tuneable clarinet barrel joint as in claim 1, further comprising a guide pin located in openings of the upper part and the lower part, the guide pin extending between the upper part and the lower part.

6. A tuneable clarinet barrel joint as in claim 1, wherein the set collar comprises a scale of markings, and wherein the transition from one marked gradation to the next marked gradation corresponds to an adjustment in the axial spacing between the upper part and the lower part of 0.2 mm to 0.8 mm, and preferably of 0.5 mm.

7. A tuneable clarinet barrel joint as in claim 6, wherein the transition from one marked gradation to the next marked gradation corresponds to a pitch adjustment of 0.5 Hz to 1.5 Hz, and preferably of 1 Hz.

* * * * *